US010746494B2

(12) United States Patent
Crawford

(10) Patent No.: US 10,746,494 B2
(45) Date of Patent: Aug. 18, 2020

(54) FOAM SWAB FOR CLEANING STAR CHAMBER IN FIREARMS

(71) Applicant: Super Brush, LLC, Fullerton, CA (US)

(72) Inventor: Brian David Crawford, Ware, MA (US)

(73) Assignee: Super Brush, LLC, Fullerton, CA (US)

( * ) Notice: Subject to any disclaimer, the term of this patent is extended or adjusted under 35 U.S.C. 154(b) by 0 days.

(21) Appl. No.: 15/715,723

(22) Filed: Sep. 26, 2017

(65) Prior Publication Data

US 2018/0149442 A1 May 31, 2018

Related U.S. Application Data

(60) Provisional application No. 62/427,452, filed on Nov. 29, 2016.

(51) Int. Cl.

| | |
|---|---|
| ***F41A 29/02*** | (2006.01) |
| *B08B 1/00* | (2006.01) |
| *B08B 9/043* | (2006.01) |

(52) U.S. Cl.

CPC ..... *F41A 29/02* (2013.01); *B08B 1/003* (2013.01); *B08B 9/0436* (2013.01)

(58) Field of Classification Search

CPC ..... F41A 29/02; F41A 29/00; F41A 29/04; B08B 1/003; B08B 9/0436

USPC ..... 42/95

See application file for complete search history.

(56) References Cited

U.S. PATENT DOCUMENTS

| | | | | |
|---|---|---|---|---|
| 1,872,198 A * | 8/1932 | Van Rixel, Jr. | F41A 29/02 | 15/104.095 |
| 3,602,935 A * | 9/1971 | McDonnell | F41A 29/02 | 15/104.09 |
| 4,291,477 A * | 9/1981 | Carlton | F41A 29/02 | 15/104.19 |
| 4,497,082 A * | 2/1985 | Kogasaka | F41A 29/02 | 15/104.165 |
| 5,337,505 A * | 8/1994 | Brown | F41A 29/02 | 15/104.165 |
| D562,935 S * | 2/2008 | Morgan | D22/199 | |

(Continued)

OTHER PUBLICATIONS

Graham Baates, AR Chamber Cleaning; A New Tool from OTiS, Feb. 2, 2016, YouTube (Year: 2016).*

(Continued)

*Primary Examiner* — Stephen Johnson
*Assistant Examiner* — Benjamin S Gomberg
(74) *Attorney, Agent, or Firm* — Donald S. Holland

(57) ABSTRACT

Applicant has disclosed a handheld tool and related method for cleaning and lubricating: the entire star chamber in a firearm (e.g., AR-15 and M-14 rifles), including the top lands, bottom lands, and canted faces of the locking lugs forming a star inlet to the chamber in a rifle; and the remaining headspace of the firearm. One tool embodiment comprises: a paddle grip; a midsection shank; and a generally T-shaped foam swab affixed over an end portion of the shank, wherein the swab has two wings and a stem. The wings are designed to fit, simultaneously or contemporaneously, between and against opposing faces of different pairs of successive locking lugs and against bottom lands of those different pairs. Afterwards, the swab can be pushed through the star inlet to clean the chamber portion behind the inlet, including the backside of the inlet.

3 Claims, 5 Drawing Sheets

(56) References Cited

U.S. PATENT DOCUMENTS

| | | | | |
|---|---|---|---|---|
| 7,836,624 | B1 * | 11/2010 | Pennington | F41A 29/02 42/95 |
| 8,250,800 | B1 * | 8/2012 | Johnson | F41A 29/02 15/104.16 |
| 8,661,724 | B2 * | 3/2014 | Crawford | F41A 29/04 15/104.16 |
| 8,793,918 | B2 * | 8/2014 | Rogers | F41A 29/02 15/104.16 |
| 9,546,841 | B2 * | 1/2017 | Vinci | F41A 29/02 |
| 9,921,023 | B2 * | 3/2018 | Evans | F41A 29/02 |
| 2006/0102200 | A1 * | 5/2006 | Esquenet | B08B 9/04 134/22.1 |
| 2015/0285578 | A1 * | 10/2015 | Hwang | F41A 29/02 42/95 |
| 2016/0015153 | A1 * | 1/2016 | Vidotto | A61F 13/38 206/232 |

OTHER PUBLICATIONS

Brownells, Inc., Brownells—AR-15 Barrel Lug Cleaning Stars, Feb. 4, 2009, YouTube (Year: 2009).*

J Dewey Rods, Dewey Rods L 16 Chamber Cleaning Kit, Jul. 7, 2016, YouTube (Year: 2016).*

SinclairInc, Sinclair Action Cleaning Tool Kit, Aug. 1, 2011, YouTube (Year: 2011).*

Off The Grid News, Guns & Ammo, Self Defense, "Ar-15: 'Ready When You Need It' Tips, Tricks and Techniques", Mar. 31, 2014. Taken from http://www.offthegridnews.com/self-defense/guns-ammo/ar-15-ready-when-you-need-it-tips-tricks-and-techniques/.

* cited by examiner

FOAM SWAB FOR CLEANING STAR CHAMBER IN FIREARMS

RELATED APPLICATION

This nonprovisional application is based upon U.S. Provisional Patent Application Ser. No. 62/427,452, filed Nov. 29, 2016. Applicant hereby incorporates the disclosure by reference of that prior application in its entirety.

FIELD OF THE INVENTION

This invention relates generally to firearms and, more particularly, to methods and devices for cleaning and lubricating the firearms.

BACKGROUND OF THE INVENTION

As explained by Brendan Atkinson—a technical advisor to the Sporting Shooters' Association of Australia—in "How to clean a firearm":

"Firearms work better, shoot straighter and last longer if they are properly maintained and treated with respect. A large part of this maintenance involves the proper cleaning and care of the working mechanisms and the all-important bore."

When a firearm is discharged, particles of burnt powder and primer residue are left in the bore, along with copper or lead-fouling depending on what bullets are being used. The next shot causes the bullet to pass over the fouling and so on for subsequent shots. If the firearm is neglected and many shots fired, a sandwich build-up of fouling can occur in the bore, especially just in front of the chamber. This, in effect, reduces the size of the bore and can result in a rise in pressure—in extreme cases, copper-clad bullets can be swaged down by this fouling so they exit the bore slightly undersized, and this is why fouling causes accuracy to drop off as more shots are fired.

In an article by Priscilla Cash, "AR-15: 'Ready When You Need It' Tips, Tricks and Techniques", Ms. Cash explained:

"Carbon buildup in the action of the AR-15 can cause jams. While some carbon can build up in your rifle's barrel and this should be cleaned occasionally, the action is where significant carbon buildup can accumulate and cause problems. The bolt carrier, the bolt, and the so-called "star chamber" . . . are the areas you most want to focus on clearing of carbon residue."

Star chambers, also known as barrel extensions, are found in, for example, M16, M-14 and AR rifles, such as the AR-15. Star chambers are where rounds of ammunition, pushed by a bolt carrier, are centered and chambered.

A ring of canted locking lugs, together with a center opening "rimmed" by top lands of the lugs, form a star inlet to a chamber behind it. The star inlet is part of the star chamber.

Star chambers can be fouled with built-up burnt powder, primer residue and, depending on the type of cartridge, copper or lead. Due to the odd configurations of star chambers, star chambers have been difficult to clean.

Firearm maintenance involves keeping the gun and its working parts free of carbon, metal particles (lead, copper, brass), and any other contaminant or foreign substance that may cause the gun to malfunction or to wear out prematurely. Firearms should generally be cleaned after firing them, and a deep cleaning should be performed periodically.

After a thorough cleaning, the next step in maintaining a firearm is to properly lubricate it. Lubrication is as important, if not more so than cleaning. To keep the firearm from malfunctioning, proper lubrication is essential and proper oiling protects metal parts from corrosion as well.

Sometimes a chamber brush (screwed into a rod) and/or a slot patch (in a slot plot holder screwed into a rod) is used to remove most of the fouling before turning to cotton swabs, such as Q-Tips® swabs.

As good as some cotton swabs are for getting into small or tight places, like the outside folds of a person's ears, those cotton swabs can leave fibers behind on a firearm's metal edges.

Some companies are selling specialized star chamber cleaning tools, such as: Otis Technology Star Chamber Tool; C. J. Weapons Chamber Maid Swab Kits; Tapco® Intrafuse® Cleaning Stars; and Real Avid AR-15 Star Chamber Stars.

Otis Technology's Star Chamber Tool (available for 5.56 mm and 7.62 mm caliber) has a nose piece which centers the tool in the star chamber. A chamber brush or other scraper components can be attached to this tool for added cleaning.

C. J. Weapons Chamber Maid Swab Kits (available for .223 and .308 caliber) each include: star-Styrofoam swabs with a center hole, straight bronze bore brush, removable handle, a flexible steel braid, and rubber coated cleaning rod. To clean the star chamber: the removable handle is threaded onto one end of the rod and the bronze brush is threaded into an opposite end of the rod; the brush is pushed into the star chamber multiple times; then a swab is pushed down onto a tip of the brush and pushed into the star chamber.

Tapco® Intrafuse® Cleaning Stars (available for AR-style and M14 rifles) are stars with a center hole. Similarly, Real Avid AR-15 Star Chamber Stars contain wool shaped stars with a center hole. Both star-shaped products apparently are designed to be used after shooters use a star-chamber brush to loosen the carbon. Then these cleaning stars are mounted, by their center holes, onto the brush tip or a cleaning rod. Solvent is added to the stars before moving them multiple times in and out of the star chamber.

Accordingly, it is a primary object of the present invention to create a more effective and efficient tool to clean, lubricate, and remove debris from the star chamber of a firearm (e.g., an AR/M14 rifle or variants).

It is another general object to provide such a tool that is lightweight, easy to use, and yet provides superior results.

SUMMARY OF THE INVENTION

Applicant has disclosed a handheld tool, and a related method, for cleaning and lubricating star chambers in firearms. Such firearms include but are not limited to AR-15 and M-14 rifles and variants.

In a preferred embodiment, Applicant's handheld tool comprises: a paddle grip; a midsection shank, affixed to the grip, having an exposed section and an unseen end section (stem); and a substantially T-shaped foam swab (or mitt) permanently affixed to the unseen end portion of the shank. The unseen end portion forms a backbone for most of the swab's stem. Preferably only the swab's T stem is affixed to the shank; that allows more flexibility and movement of the swab's T arm or wings.

The locking lugs, forming the star inlet, resemble the teeth of some gears. Each lug includes a canted face (here, substantially straight) on each side, a top land and, between each pair of successive lugs, a bottom land. Successive lugs have oppositely canted faces ("opposing faces") compared to the lug next to it.

Each wing of Applicant's T-shaped foam swab is shaped, along the wing's leading edge and side, to fit (by compression of the wing) between and against the opposing faces of two successive lugs and their bottom land.

A shooter can use each wing of Applicant's swab to clean, simultaneously (or contemporaneously) with the other wing, opposing faces between different pairs of successive locking lugs, and the bottom lands between each pair. The bottom lands being cleaned simultaneously are approximately 180° apart.

Applicant's swab is designed to easily pass through adjacent locking lugs of the barrel extension and re-expand into the chamber allowing 360° of access. The stem's free end, due to its shape, can be inserted into the barrel end for centering. Then the tool can be rotated around its longitudinal axis to clean the chamber and the barrel end.

BRIEF DESCRIPTION OF DRAWINGS

The above and other objects and advantages of the present invention will become more readily apparent upon reading the following description and drawings in which.

DETAILED DESCRIPTION OF PREFERRED EMBODIMENT(S)

Applicant has disclosed a handheld tool and a related method for cleaning and lubricating star chambers in firearms. Such firearms (not shown) include but are not limited to AR-15 and M-14 rifles and variants. Super Brush LLC markets this new product under "SWAB-ITS® Star Chamber Cleaning Foam Swabs". "SWAB-ITS" is a registered trademark belonging to Super Brush LLC.

Figure 9:
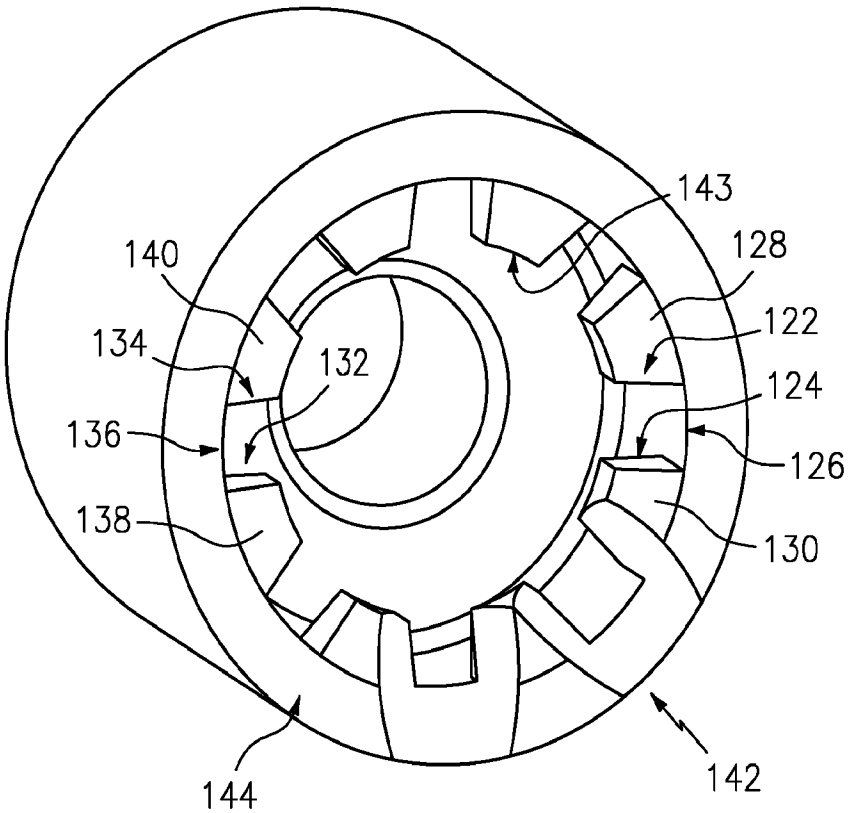
FIG. 9 (PRIOR ART)
FIG. 9 is an enlarged view of the star inlet shown in FIG. 8 but with the soiling removed for simplicity.
Figure 8:
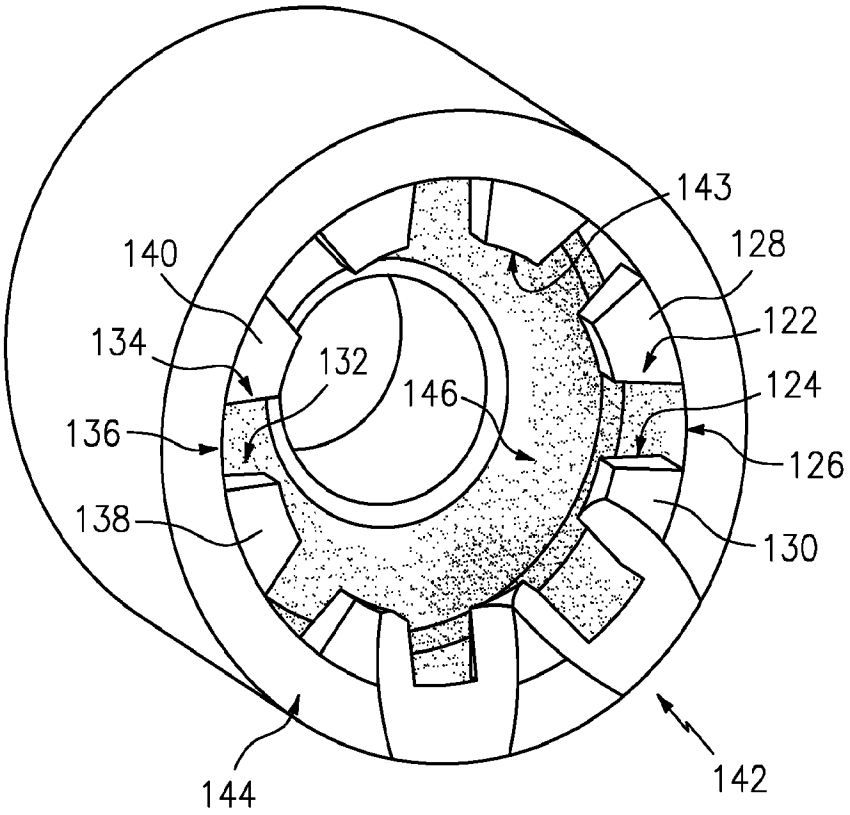
FIG. 8 (PRIOR ART)
FIG. 8 is a perspective view of a soiled star chamber of an AR-15.

As used in this application, the term "opposing face" or "opposing faces" means the oppositely canted faces between successive locking lugs of the star inlet. Each locking lug of a star inlet (see FIGS. 8, 9) has a straight face, like some gear teeth. Between the opposing faces of successive locking lugs (of the star inlet) is a bottom land.

As shown in the accompanying FIGS. 1-9, Applicant's preferred embodiment 100 of a star chamber cleaner comprises: a molded plastic (polypropylene) paddle grip 102; a midsection shank 104 (molded polypropylene) integral with the paddle grip 102; and a substantially T-shaped foam swab (or mitt) 106 permanently affixed (preferably bonded) to an unseen end portion (or stem) 108 of the shank.

The anatomy of the letter "T" comprises a stem and one arm. Applicant sometimes refers to the T arm 110 of swab 106 as wings 112*a*, 112*b* in this application. The T stem, of swab 106, is referenced as 114.

Figure 4:
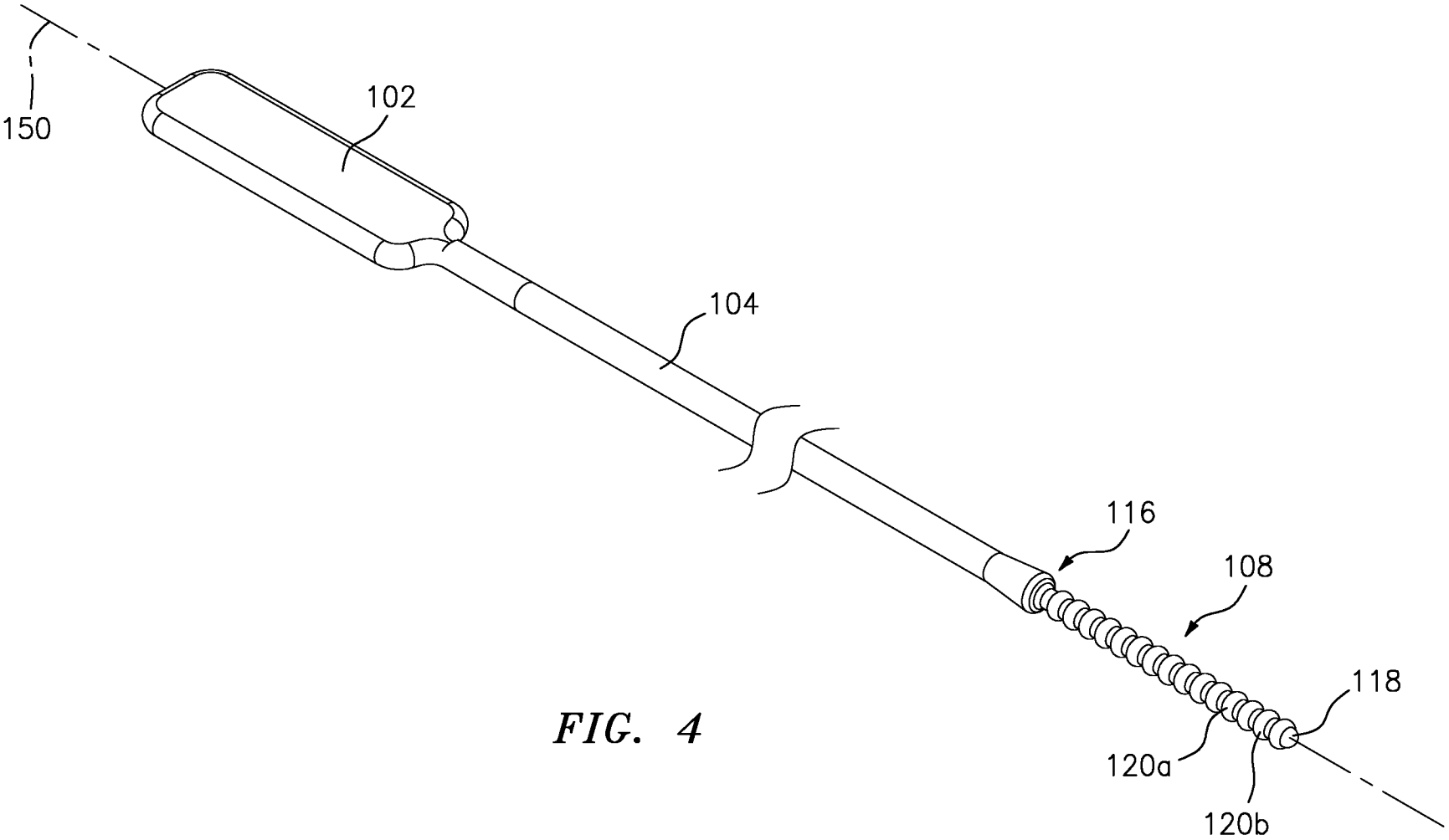
FIG. 4 is an enlarged top view of the swab of FIG. 1.
Figure 5:
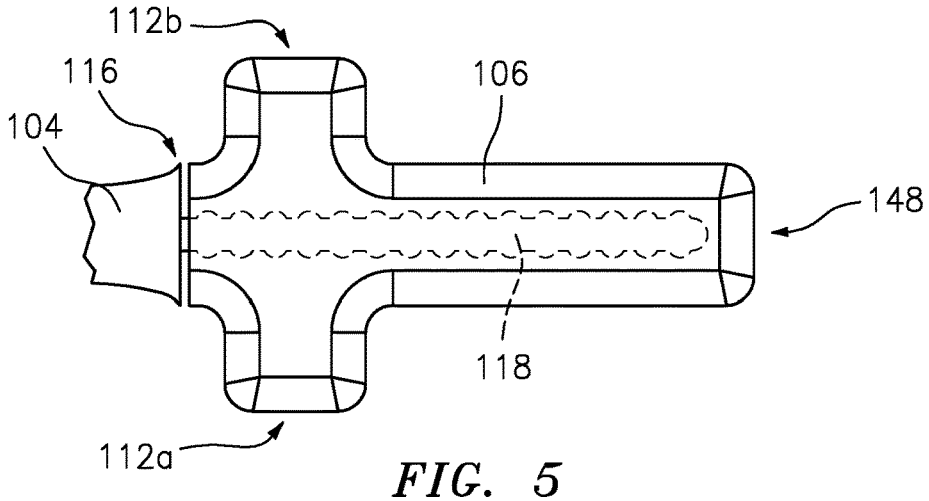
FIG. 5 is a perspective view of a paddle and a shank, shown in FIG. 1, prior to the swab being added.

FIG. 4 shows shank 104 before bonding. Shank 104 includes an annular shoulder 116 followed by the end portion 108. End portion 108 comprises a rod 118 with a series of annular spacers or ridges (e.g., 120*a*, 120*b*), spaced apart. These spaced ridges provide a sealing surface for the swab 106 without requiring the entire end portion 108 subject to the sealing heat. The ridges (e.g., 120*a*, 120*b*) protect the rest of rod 118 from being melted and thus becoming brittle and subject to greater breakage. The spaced ridges (e.g., 120*a*, 120*b*) also maintain flexibility of the end portion 108 after bonding.

Applicant's SWAB-ITS® star chamber cleaner 100 is made from a preferred process (not shown). Two sheets (not shown) of zapped polyurethane foam are placed onto the melted ridges (e.g., 120*a*, 120*b*) to bond the sheets to the shank 104. Then the affixed sheets are cut. Next the cut sheets are sealed thermally to provide tight seams. Preferably only the swab's T stem 114 is affixed to the shank 104; that allows more flexibility and movement of the swab's T arm 110.

Figure 1:
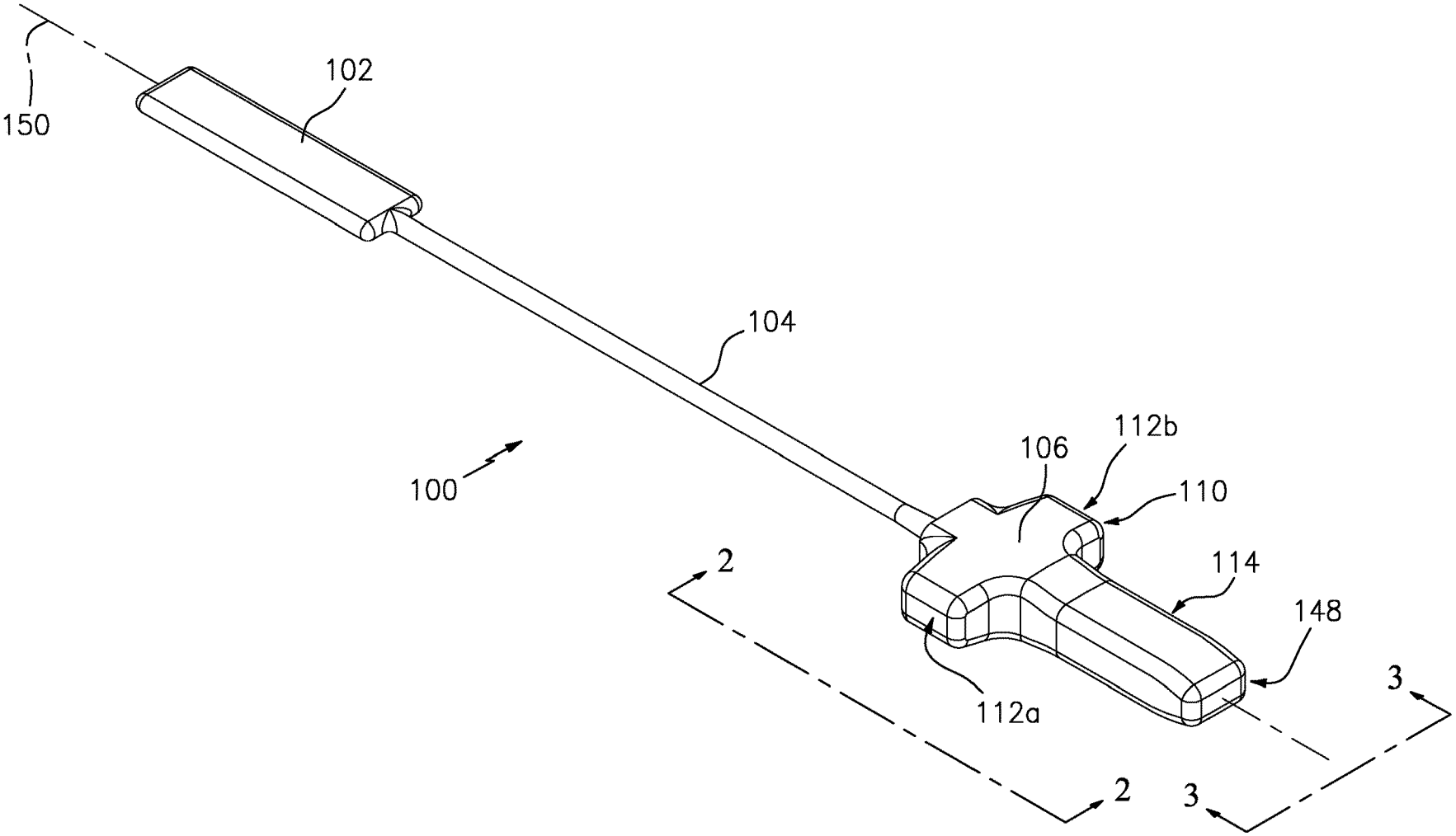
FIG. 1 is a perspective view of a preferred star chamber cleaner constructed in accordance with Applicant's invention.
Figure 2:
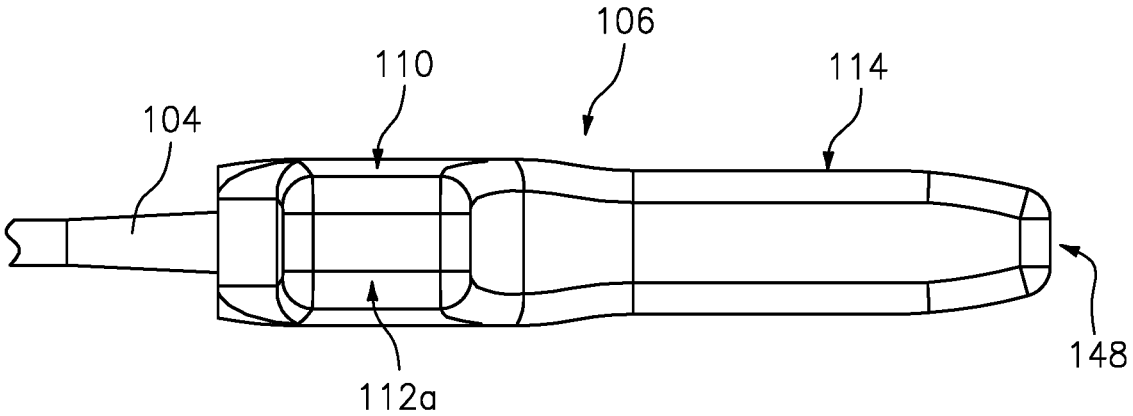
FIG. 2 is an enlarged side plan view of a foam swab taken along sight line 2-2 of FIG. 1.
Figure 3:
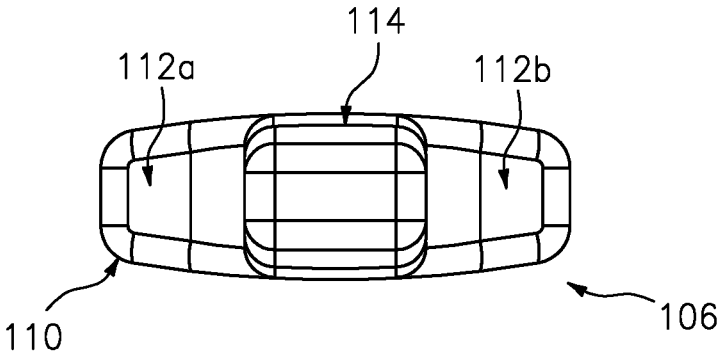
FIG. 3 is an enlarged front plan view of the swab taken along sight line 3-3 of FIG. 1.

As shown in FIG. 1, the end portion 108 of shank 106 extends through most of the swab's T stem 114.

UFP Technologies has described zapping, also known as thermal reticulation, as:

"Zapping is a process that involves placing a bun of foam in a very large vacuum pressure vessel known as a 'zapper.' The vessel is evacuated and filled with an explosive gas mixture. The gas is ignited and a controlled flame front passes through the foam, melting the window membranes and leaving the skeletal structure intact. Zapping works with both polyester and polyether polyurethanes. The benefit of the zapping process is a smooth, clean polished cell stand."

In the preferred embodiment 100, the T-shaped mitt 106 (when designed for an AR-15/M-14 rifle) is approximately 1.90 inches long and approximately 0.5 inches thick; the T stem 114 is approximately 1.40 inches long and approximately 0.50 inches wide; and the T arm 110 is approximately 1.25 inches long. The mitt 106 tapers at its seams (see FIGS. 1-3).

Each wing 112*a*, 112*b* is substantially shaped, along its side and leading edge, like the space formed by opposing faces (e.g., 122, 124) and a bottom land (e.g., at 126)(see FIGS. 8, 9) of two successive locking lugs (e.g., 128, 130) but longer and wider.

Wing 112*a* is adapted in size and shape to fit (by compression) between and against opposing faces (e.g., 122, 124) and a bottom land (e.g., 126) of successive lugs (e.g., 128, 130). Wing 112*b* is adapted in size and shape to fit (by compression) simultaneously or near the same time (i.e., contemporaneously) between and against two other opposing faces (e.g., 132, 134) and a different bottom land (e.g., 136) between two other successive lugs (e.g., 138, 140). The bottom lands 126, 136 are approximately 180° apart; so too are the wing tips.

As shown in FIGS. 1 and 5-7, wing 112*a* extends from one side of T stem 110. Wing 112*b* extends from another side of T stem 110. Each wing is integral with the stem.

Due to the mitt's dimensions and materials, a shooter (not shown) easily can clean and lubricate: the entire star chamber 142, including the top lands (e.g., 143) and bottom lands (e.g., at 126, 136) and opposing faces (e.g., at 122, 124 and 132, 134) forming the star inlet 144, by, e.g., using T wings 112*a*, 112*b*.

There are multiple was to clean a star inlet with Applicant's SWAB-ITS® star chamber cleaner 100. Typically the wings 112*a*, 112*b* are inserted respectively, between and against opposing faces (e.g., 122, 124 and 132, 134) and bottom lands (e.g., 126, 136), then retracted. (The compressed wings 112*a*, 112*b* expand upon removal.) This "in and out" process (insertion and retraction) can be repeated, for the same opposing faces and bottom land, if desired. Then the tool is rotated, around its longitudinal axis. The wings 112*a*, 112*b* are inserted into the next pairs of opposing lug faces and bottom lands, substantially 180° apart, and retracted from the star inlet 144. This process continues until all of the locking lug faces and associated bottom lands have been cleaned.

Sometimes users rotate the wings 112*a*, 112*b* in a continuous motion to clean all the opposing faces and bottom lands in the star inlet 144. But that is not the most thorough method to clean those areas with Applicant's swab cleaner 100.

Applicant's SWAB-ITS® star chamber cleaner 100 also is designed to easily pass, by compression of the wings, through the star inlet 144 (e.g., through adjacent locking lugs) and then re-expand into the rest of star chamber 142 (i.e., a chamber 146 behind the star inlet 144) allowing 360° of access. A free end 148 T stem 114 can be inserted into the barrel end (not shown) for centering. Then Applicant's SWAB-ITS® star chamber cleaner 100 can be rotated around its longitudinal axis 150 to clean the headspace in the chamber 146 (e.g., the inner diameter), including the back of the star inlet 144.

Applicant's T arm 110, of swab 106, can also be used to clean the remaining headspace (not shown) of the firearm. In firearms, headspace is the distance measured from the face of the bolt (not shown) to the part of another chamber that stops forward motion of a cartridge. The preferred swab 106 design calls for material (foam) which will compresses against walls of the barrel extension and thus making tight contact with the inner walls of the firearm.

Applicant's SWAB-ITS® star chamber cleaner 100 also can be used to lubricate the star chamber, its star inlet 144 and the remaining headspace of the firearm. Place a few drops of lubricating fluid onto the swab 106. Then repeat the steps above.

Applicant's SWAB-ITS® star chamber cleaner 100 (i.e., the paddle 102, shank 104 and swab 106) are flexible enough to easily enter through the ejection port on the upper receiver (not shown), without breaking down the firearm.

Figure 6:
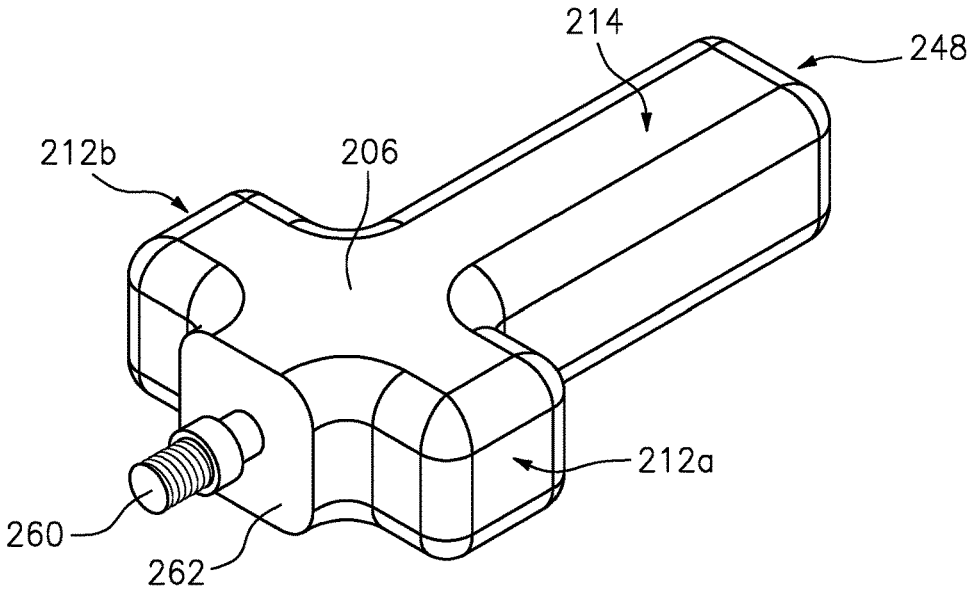
FIG. 6 is a perspective view of an alternate embodiment of Applicant's star chamber cleaner.
Figure 7:
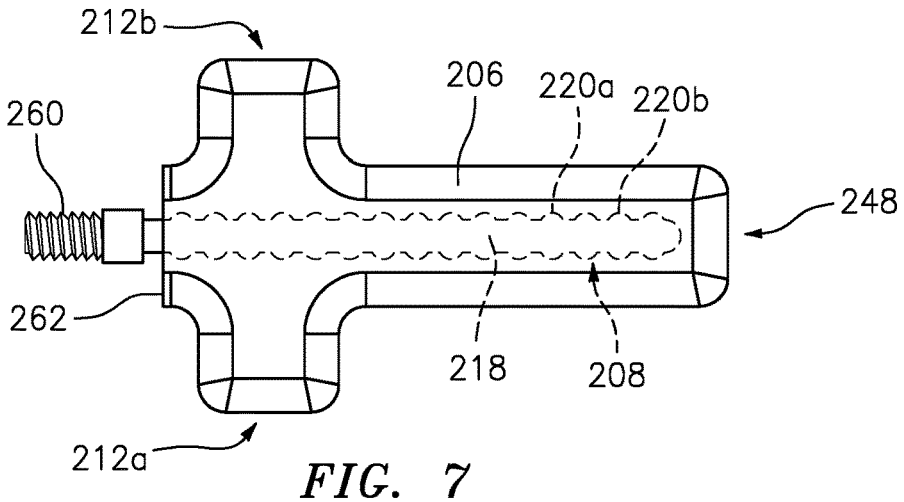
FIG. 7 is a top plan view of a swab of the alternate embodiment.

FIGS. 6-7 depict an alternate embodiment 200 of Applicant's SWAB-ITS® star chamber cleaner. Most parts of this alternate star chamber cleaner 200 are found in the preferred embodiment 100. Like parts in FIGS. 6-7 (compared to FIGS. 1-5) use the "prefix" 200 instead of 100. For example, swab 108 is referenced as 208 in the alternate embodiment.

There is no paddle grip in the alternate embodiment 200. Instead, an externally threaded stub 260, attached to a modified shoulder 262 of the shank 204, enables the star chamber cleaner 200 to be threaded into a cleaning rod (not shown). Also the shank 204 is shortened to the shoulder 262 and the unseen, after bonding, end portion 208. That unseen portion 208 serves as the backbone for T stem 214. As shown in FIG. 6, the unseen portion 208 has spacers or ridges (e.g., 220*a*, 220*b*) for bonding.

Some other advantages of either embodiment 100, 200 of Applicant's invention include: precision cleaning; a tight fit; and maximum lubrication. No residue is left behind like the shedding from cotton swabs; and the standard patch is eliminated for cleaning.

Less cleaning solution is used with Applicant's SWAB-ITS® star chamber cleaner 100, 200. Instead of constantly pouring liquid over a traditional cleaning patch, Applicant's foam mitts 106, 206 can be soaked once in cleaning solution and if desired dipped for a second time. Applicant's swabs (mitts) 106, 206 provide even dispersion of cleaning and lubricating fluids in the barrel extension and chamber.

Applicant's star chamber cleaner 100, 200 also: cleans the firearm's headspace and barrel extension in one motion; provides a visual indicator of cleanliness; and has no metal components.

Applicant's embodiment 100 can be thought of as a method of cleaning a star inlet of a star chamber in a rifle, the method comprising:

a. holding a handle (e.g., a paddle grip or a cleaning rod) with an attached substantially T-shaped foam swab comprised of a stem and an arm substantially perpendicular to the stem;
   i. wherein the arm comprises a first wing and a second wing,
b. cleaning opposing faces and bottom lands of successive locking lugs of the star inlet by:
   i. inserting the first wing, while holding the handle, between and against opposing faces of two successive locking lugs and against a first bottom land between the two successive locking lugs;
   ii. contemporaneously with step b.i., inserting the second wing, while holding the handle, between and against opposing faces of two other successive locking lugs and against a second bottom land, between the two other successive lugs;
   iii. wherein the first bottom land and the second bottom land are spaced apart 180°; and
   iv. removing the first wing from between the two successive locking lugs and removing the second wing from between the two other successive lugs.

Additional method steps comprise:

a. cleaning a headspace portion of the star chamber behind the star inlet; and
b. inserting the free end of the swab into a barrel end, closest to the star inlet, and rotating the tool to clean the headspace portion and the barrel end.

It should be understood by those skilled in the art that obvious structural modifications can be made without departing from the spirit of the invention. For example, the paddle grip 102 could be omitted, whereby the shank 104 could act instead as the handle. Or the mitt 106, 206 could be made of different material. Accordingly, reference should be made primarily to the accompanying Claims rather than the foregoing Specification to determine the scope of the invention.

What is claimed is:

1. A method of cleaning a star chamber in a rifle, the method comprising:

a. inserting and simultaneously compressing a first wing of a foam swab simultaneously: between and against opposing faces of two successive locking lugs of a star inlet of the star chamber and against a first bottom land between the two successive locking lugs;
b. contemporaneously with the step of inserting and simultaneously compressing the first wing, inserting and simultaneously compressing a second wing of the foam swab simultaneously: between and against opposing faces of two other successive locking lugs of the star inlet and against a second bottom land between the two other successive locking lugs;
   i. wherein the second bottom land is spaced 180° from the first bottom land about a longitudinal axis of the star chamber;

c. removing the first wing from between the two successive locking lugs; and d. removing the second wing from between the two other successive locking lugs.

2. The method of claim 1 further comprising:

a. expanding the first wing and the second wing by pushing the first wing and the second wing through the star inlet into a chamber of the star chamber behind the star inlet; and b. after pushing the first wing and the second wing into the chamber, rotating the swab to clean a headspace of the chamber with the first wing and the second wing.

3. A method of cleaning a star chamber of a rifle, the method comprising:

a. holding a paddle grip with an attached foam swab comprised of a stem and, extending perpendicularly from opposite sides of the stem, a first wing and a second wing;

b. pushing, while holding the paddle grip, the first wing and the second wing through a star inlet of the star chamber into a headspace of the star chamber behind the star inlet, whereupon the first wing and the second wing, upon entering the headspace, expand such that the first wing and the second wing contact the headspace;

c. after pushing the first wing and the second ring into the headspace, inserting a free end of the stem into a barrel end, closest to the star inlet, and d. upon inserting the free end of the stem into the barrel end, rotating the swab to clean the barrel end with the free end of the stem and to clean the headspace with the first wing and the second wing.

* * * * *